US005932346A

United States Patent [19]

Kent et al.

[11] Patent Number: 5,932,346

[45] Date of Patent: Aug. 3, 1999

[54] MULTIPLE DOMAIN FIBERS HAVING INTER-DOMAIN BOUNDARY COMPATIBILIZING LAYER AND METHODS OF MAKING THE SAME

[75] Inventors: Diane R. Kent; Matthew B. Hoyt, both of Arden; Charles F. Helms, Jr., Asheville, all of N.C.

[73] Assignee: BASF Corporation, Mt. Olive, N.J.

[21] Appl. No.: 09/004,032

[22] Filed: Jan. 7, 1998

Related U.S. Application Data

[60] Provisional application No. 60/034,743, Jan. 10, 1997.

[51] Int. Cl.[6] ..... D02G 3/00

[52] U.S. Cl. ..... 428/373; 428/374; 428/397

[58] Field of Search ..... 428/373, 374, 428/397

[56] References Cited

U.S. PATENT DOCUMENTS

| | | | |
|---|---|---|---|
| 2,989,798 | 6/1961 | Bannerman | 28/82 |
| 3,718,534 | 2/1973 | Okamoto et al. | 161/373 |
| 4,069,363 | 1/1978 | Segraves et al. | 428/224 |
| 4,087,588 | 5/1978 | Shida et al. | 428/500 |
| 4,370,114 | 1/1983 | Okamoto et al. | 425/131.5 |
| 4,439,487 | 3/1984 | Jennings | 428/397 |
| 4,732,809 | 3/1988 | Harris et al. | 428/373 |
| 4,789,592 | 12/1988 | Taniguchi et al. | 428/373 |
| 5,166,278 | 11/1992 | Rao | 525/432 |
| 5,372,885 | 12/1994 | Tabor et al. | 428/373 |
| 5,445,884 | 8/1995 | Hoyt et al. | 428/370 |
| 5,582,913 | 12/1996 | Simons | 428/373 |
| 5,780,156 | 7/1998 | Hoyt et al. | 428/373 |

*Primary Examiner*—Newton Edwards
*Attorney, Agent, or Firm*—Laura D. Nammo

[57] ABSTRACT

Multicomponent fibers and methods of producing the same are provided such that an inter-domain boundary layer is interposed between distinct domains formed of incompatible polymers so as to minimize (if not eliminate entirely) separation of the domains at their interfacial boundary. The polymer forming the inter-domain boundary layer therefore is provided so as to be compatible with the otherwise incompatible polymers forming each of the domains between which it is interposed.

16 Claims, 3 Drawing Sheets

MULTIPLE DOMAIN FIBERS HAVING INTER-DOMAIN BOUNDARY COMPATIBILIZING LAYER AND METHODS OF MAKING THE SAME

CROSS-REFERENCE TO RELATED APPLICATIONS

This application claims priority of U.S. Provisional patent application Ser. No. 60/034,743, filed Jan. 10, 1997 now abandoned.

This application may be deemed to be related to commonly owned copending U.S. patent application Ser. No. 09/004,676, which claims priority of U.S. Provisional patent application Ser. No. 60/034,744, filed Jan. 10, 1997, in the names of Charles F. Helms, Jr., et al. entitled "Multiple Domain Fibers Having Inter-Domain Boundary Compatibilizing Layer and Methods and Apparatus for Making the Same" and now abandoned, the entire content of which is expressly incorporated hereinto by reference.

FIELD OF INVENTION

The present invention relates generally to synthetic fibers and the techniques by which such synthetic fibers are made. More particularly, the present invention relates to synthetic fibers having multiple distinct polymer domains formed of non-compatible polymers and an inter-domain compatibilizing boundary layer between the distinct domains.

BACKGROUND AND SUMMARY OF THE INVENTION

Multicomponent fibers are, in and of themselves, well known and have been used extensively to achieve various fiber properties. For example, multicomponent fibers have been formed of two dissimilar polymers so as to impart self-crimping properties. See, e.g., U.S. Pat. Nos. 3,718,534 to Okamoto et al. and 4,439,487 to Jennings. Multicomponent fibers of two materials having disparate melting points for forming point bonded nonwovens are known, for example, from U.S. Pat. No. 4,732,809 to Harris et al. Asymmetric nylon-nylon sheath-core multicomponent fibers are known from U.S. Pat. No. 4,069,363 to Segraves et al.

One problem that is encountered when multicomponent fibers are formed having distinct domains of dissimilar polymers which are incompatible with one another is that the domains often separate at the boundary between the domains. This separation results in fracturing or splitting of the fiber thereby weakening the system (e.g., yarn, fabric, carpet or like textile product) in which the fiber is used. Weakening of the fiber system can be sufficiently acute to prevent the system from undergoing downstream processing (e.g., drawing, texturing, heat-setting, tufting, knitting, weaving and the like). Furthermore, such fracturing and/or splitting of the fibers can result in poor product qualities, such as poor appearance and poor wear performance.

It would, therefore, be highly desirable if multicomponent fibers having distinct longitudinally coextensive polymer domains formed of incompatible polymers could be produced which have minimal (if any) inter-domain fracturing and/or splitting. It is toward providing such a fiber and method of producing the same that the present invention is directed.

Broadly, the present invention is directed to a multicomponent fiber and a method of producing the same whereby an inter-domain boundary layer is interposed between distinct domains formed of incompatible polymers so as to minimize (if not eliminate entirely) separation of the domains at their interfacial boundary. The polymer forming the inter-domain boundary layer therefore is provided so as to be compatible with the otherwise incompatible polymers forming each of the domains between which it is interposed.

These and other aspects and advantages of the present invention will become more clear after careful consideration is given to the detailed description of the preferred exemplary embodiments thereof which follow.

BRIEF DESCRIPTION OF THE DRAWINGS

Reference will hereinafter be made to the accompanying drawings wherein like reference numerals throughout the various FIGURES denote like structural elements, and wherein.

DETAILED DESCRIPTION OF THE PREFERRED EXEMPLARY EMBODIMENTS

Figure 1:
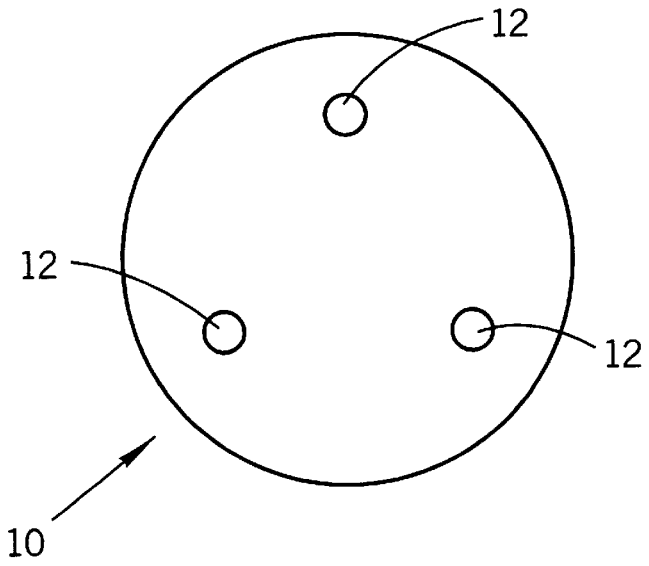
FIGS. 1 and 2 are enlarged diagrammatic plan views of polymer flow distribution plates that may be employed in a fiber spin pack to produce a representative multicomponent fiber according to the present invention.

As used herein and in the accompanying claims, the term "fiber-forming" is meant to refer to at least partly oriented, partly crystalline, linear polymers which are capable of being formed into a fiber structure having a length at least 100 times its width and capable of being drawn without breakage at least about 10%. The term "non-fiber-forming" is therefore meant to refer to amorphous (non-crystalline) linear polymers which may be formed into a fiber structure, but which are incapable of being drawn without breakage at least about 10%.

The term "fiber" includes fibers of extreme or indefinite length (filaments) and fibers of short length (staple).

The term "yarn" refers to a continuous strand or bundle of fibers.

The term "multicomponent fiber" is a fiber having at least two distinct cross-sectional longitudinally coextensive domains respectively formed of different incompatible polymers. The distinct domains may thus be formed of polymers from different polymer classes (e.g., nylon and polypropylene) or be formed of polymers from the same polymer class (e.g., nylon) but which differ in their respective physical and/or chemical properties including, for example, differing relative viscosities, types or amounts of additives present, such as colorants, and the like. The term "multicomponent fiber" is thus intended to include concentric and eccentric sheath-core fiber structures, symmetric and asymmetric side-by-side fiber structures, island-in-sea fiber structures and pie wedge fiber structures.

The term "incompatible polymers" and like terms are meant to refer to polymers which cannot be melt-blended with one another. Thus, when incompatible polymers are melt-spun to form a multicomponent fiber having distinct cross-sectional domains formed from each respective incompatible polymer, there will be substantially no inter-domain adhesion at the boundary layer(s) therebetween.

Virtually any fiber-forming polymer may be usefully employed in the practice of this invention. In this regard, suitable classes of polymeric materials that may be employed in the practice of this invention include polyamides, polyesters, acrylics, polyolefins, maleic anhydride grafted polyolefins, and acrylonitriles. More specifically, nylon, low density polyethylene, high density polyethylene, linear low density polyethylene and polyethylene terephthalate may be employed. Each distinct domain forming the bicomponent fibers of this invention may be formed from different incompatible polymeric materials. Alternatively, some of the domains may be formed from incompatible polymers while other domains may be formed from polymers which are compatible with the polymer, forming an adjacent domain.

One particularly preferred class of polymers used in forming the bicomponent fibers of this invention is polyamide polymers. In this regard, those preferred polyamides useful to form the bicomponent fibers of this invention are those which are generically known by the term "nylon" and are long chain synthetic polymers containing amide (—CO—NH—) linkages along the main polymer chain. Suitable melt spinnable, fiber-forming polyamides for the sheath of the sheath-core bicomponent fibers according to this invention include those which are obtained by the polymerization of a lactam or an amino acid, or those polymers formed by the condensation of a diamine and a dicarboxylic acid. Typical polyamides useful in the present invention include nylon 6, nylon 6/6, nylon 6/9, nylon 6/10, nylon 6T, nylon 6/12, nylon 11, nylon 12, nylon 4,6 and copolymers thereof or mixtures thereof. Polyamides can also be copolymers of nylon 6 or nylon 6/6 and a nylon salt obtained by reacting a dicarboxylic acid component such as terephthalic acid, isophthalic acid, adipic acid or sebacic acid with a diamine such as hexamethylene diamine, methaxylene diamine, or 1,4-bisaminomethylcyclohexane. Preferred are poly-$\epsilon$-caprolactam (nylon 6) and polyhexamethylene adipamide (nylon 6/6). Most preferred is nylon 6. The preferred polyamides will exhibit a relative viscosity of between about 2.0 to about 4.5, preferably between about 2.4 to about 4.0.

The distinct domains of the multicomponent fibers according to this invention may also be formed of an amorphous linear polymer which in and of itself is non-fiber-forming. Suitable amorphous polymers for use in the practice of this invention include polystyrene, polyisobutene and poly(methyl methacrylate). When employed in the primary and/or secondary cores, the amorphous polymer is most preferably an amorphous polystyrene, with amorphous atactic polystyrene being particularly preferred.

Another suitable class of polymers that is generally incompatible with polyamides is polyolefin polymers, such as polyethylene, polypropylene and the like. When nylon 6 is employed as one domain of the multicomponent fiber according to this invention, polypropylene is preferred for at least one other domain.

The compatibilizing boundary layer is selected so as to be compatible (blendable) with the polymers forming the adjacent longitudinally coextensive cross-sectional fiber domains between which the boundary layer is interposed. For example, when nylon 6 and polypropylene are employed as the polymers in adjacent domains, the compatibilizing boundary layer is most preferably maleic anhydride modified polypropylene.

The multicomponent fibers are spun using conventional fiber-forming equipment. Thus, for example, separate melt flows of the polymers having different relative viscosities may be fed to a conventional multicomponent spinnerette pack such as those described in U.S. Pat. Nos. 5,162,074, 5,125,818, 5,344,297, 5,445,884 and 5,533,883 (the entire content of each patent being incorporated expressly hereinto by reference) where the melt flows are combined to form extruded multi-lobal (e.g., tri-, tetra-, penta- or hexalobal) fibers having two distinct polymer domains, for example, sheath and core structures. Preferably, the spinnerette is such that fibers having a tri-lobal structure with a modification ratio of at least about 2.0, more preferably between 2.2 and 4.0 may be produced. In this regard, the term "modification ratio" means the ratio $R_1/R_2$, where $R_2$ is the radius of the largest circle that is wholly within a transverse cross-section of the fiber, and $R_1$ is the radius of the circle that circumscribes the transverse cross-section.

The extruded fibers are quenched, for example, with air, in order to solidify the fibers. The fibers may then be treated with a finish comprising a lubricating oil or mixture of oils and antistatic agents. The thus formed fibers are then combined to form a yarn bundle which is then wound on a suitable package.

In a subsequent step, the yarn is drawn and texturized to form a bulked continuous fiber (BCF) yarn suitable for tufting into carpets. A more preferred technique involves combining the extruded or as-spun fibers into a yarn, then drawing, texturizing and winding into a package all in a single step. This one-step method of making BCF is generally known in the art as spin-draw-texturing (SDT).

Nylon fibers for the purpose of carpet manufacturing have linear densities in the range of about 3 to about 75 denier/filament (dpf) (denier=weight in grams of a single fiber with a length of 9000 meters). A more preferred range for carpet fibers is from about 15 to 28 dpf.

The BCF yarns can go through various processing steps well known to those skilled in the art. For example, to produce carpets for floor covering applications, the BCF yarns are generally tufted into a pliable primary backing. Primary backing materials are generally selected from woven jute, woven polypropylene, cellulosic nonwovens, and nonwovens of nylon, polyester and polypropylene. The primary backing is then coated with a suitable latex material such as a conventional styrene. butadiene (SB) latex, vinylidene chloride polymer, or vinyl chloride-vinylidene chloride copolymers. It is common practice to use fillers such as calcium carbonate to reduce latex costs. The final step is to apply a secondary backing, generally a woven jute or woven synthetic such as polypropylene. Preferably, carpets for floor covering applications will include a woven polypropylene primary backing, a conventional SB latex formulation, and either a woven jute or woven polypropylene secondary carpet backing. The SB latex can include calcium carbonate filler and/or one or more of the hydrate materials listed above.

While the discussion above has emphasized the fibers of this invention being formed into bulked continuous fibers for purposes of making carpet fibers, the fibers of this invention can be processed to form fibers for a variety of textile applications. In this regard, the fibers can be crimped or otherwise texturized and then chopped to form random lengths of staple fibers having individual fiber lengths varying from about 12 to about 8 inches.

The fibers of this invention can be dyed or colored utilizing conventional fiber-coloring techniques. For example, the fibers of this invention may be subjected to an acid dye bath to achieve desired fiber coloration. Alternatively, the nylon sheath may be colored in the melt prior to fiber-formation (i.e., solution dyed) using conventional pigments for such purpose.

Further understanding of this invention will be obtained from the following non-limiting Examples which illustrate specific embodiments thereof.

Example 1

The two primary polymers that are used for this Example are nylon 6 (Ultramid® BS-700F available from BASF Corporation) and polypropylene (Fortilene® 3808 available from Solvay Polymers of Houston, Tex.). The polymer employed as the inter-domain compatibilizing layer is maleic anhydride modified polypropylene (MA-PP) commercially available from Aristech chemical of Pittsburgh, Pa. under the tradename Unite MP320.

The polymers are extruded using equipment as described in U.S. Pat. No. 5,244,614 to Hagen (the entire content of which is expressly incorporated hereinto by reference). The relative amounts of each polymeric component are 65 wt. % nylon 6, 25% polypropylene and 10% MA-PP. Final extruder zone temperatures for each polymer are 275° C. for the nylon 6, 225° C. for polypropylene, and 100° C. for the MA-PP. The spin pack temperature is 270° C.

The spin pack is designed using thin plates such as those described in U.S. Pat. Nos. 5,344,297, 5,162,074 and 5,551,588, each issued to Hills (the entire content of each being expressly incorporated hereinto by reference). Above the backhole leading to the spinning capillary are thin plates designed as illustrated in FIG. 1 to deliver the polypropylene and MA-PP in a core-sheath configuration, respectively. Specifically, the thin plate 10 will include a number (e.g., three) equidistantly symmetrically spaced-apart primary core apertures 12 to simultaneously receive the polypropylene component surrounded entirely by a sheath of the MA-PP.

The individual polymer flows are directed by the thin plate 10 of FIG. 1 and are processed by the apparatus disclosed in U.S. Pat. No. 2,989,789 to Bannerman (the entire content of which is expressly incorporated hereinto by reference) where the MA-PP coats the polypropylene except there is no spinnerette capillary below the chamber where the materials are combined. Instead, this is above a thin plate and spinnerette backhole such that there are three round sheath-core flows of MA-PP and polypropylene, respectively, delivered to the backhole.

Figure 2:
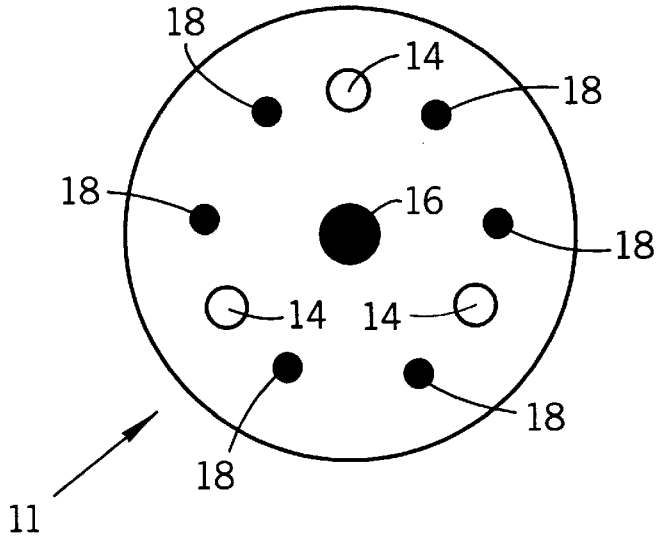
Figure 3:
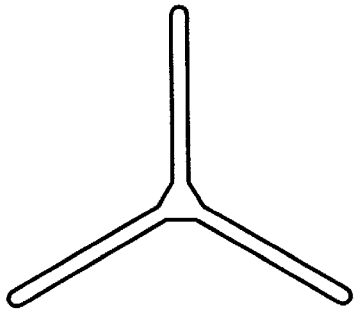
FIG. 3 is an enlarged diagrammatic plan view of a spinneret trilobal orifice configuration that may be employed downstream of the polymer flow distribution plates shown in FIGS. 1 and 2.

The entire flow of polymers—namely, the nylon 6, MA-PP and polypropylene—is divided into 58 separate flows, each of which is fed into a backhole plate 11 having the pattern illustrated in FIG. 2. In this regard, holes 14 receive the MA-PP sheath-core flow, while the nylon 6 flow is divided among holes 16 and 18. Specifically, hole 16 receives approximately 50% of the nylon 6, while holes 18 each receive approximately 8.3% of the nylon 6. The backhole plate 11 feeds a conventional trilobal spinnerette opening as illustrated in FIG. 3.

The fibers are cooled, drawn and textured in a continuous spin-draw apparatus (Rieter J0/10) using a draw ratio of 2.8 and a winding speed of 2200 meters per minute.

Figure 4:
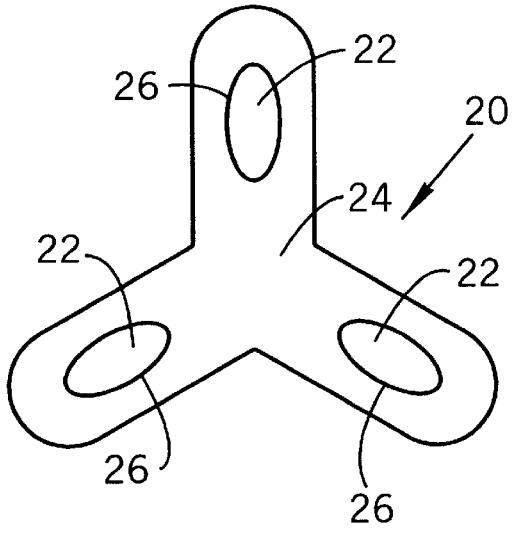
FIG. 4 is an enlarged diagrammatic cross-sectional view of one possible multicomponent fiber in accordance with this invention that may be produced using the polymer flow distribution plates and spinneret orifice depicted in FIGS. 1–3, respectively.

A cross-section of the resulting fiber 20 is shown in accompanying FIG. 4. As shown, the fiber 20 has a trilobal cross-section and includes three radially elongate cores 22 in each lobes which are entirely surrounded by a nylon 6 sheath 24. Each of the core domains 22 is longitudinally coextensive with the sheath domain 24. An inter-domain compatibilizing boundary layer 26 is interposed between each of the domains 22 and the surrounding nylon 6 domain 24 and serves to increase the adhesion therebetween.

Example 2

Figure 5:
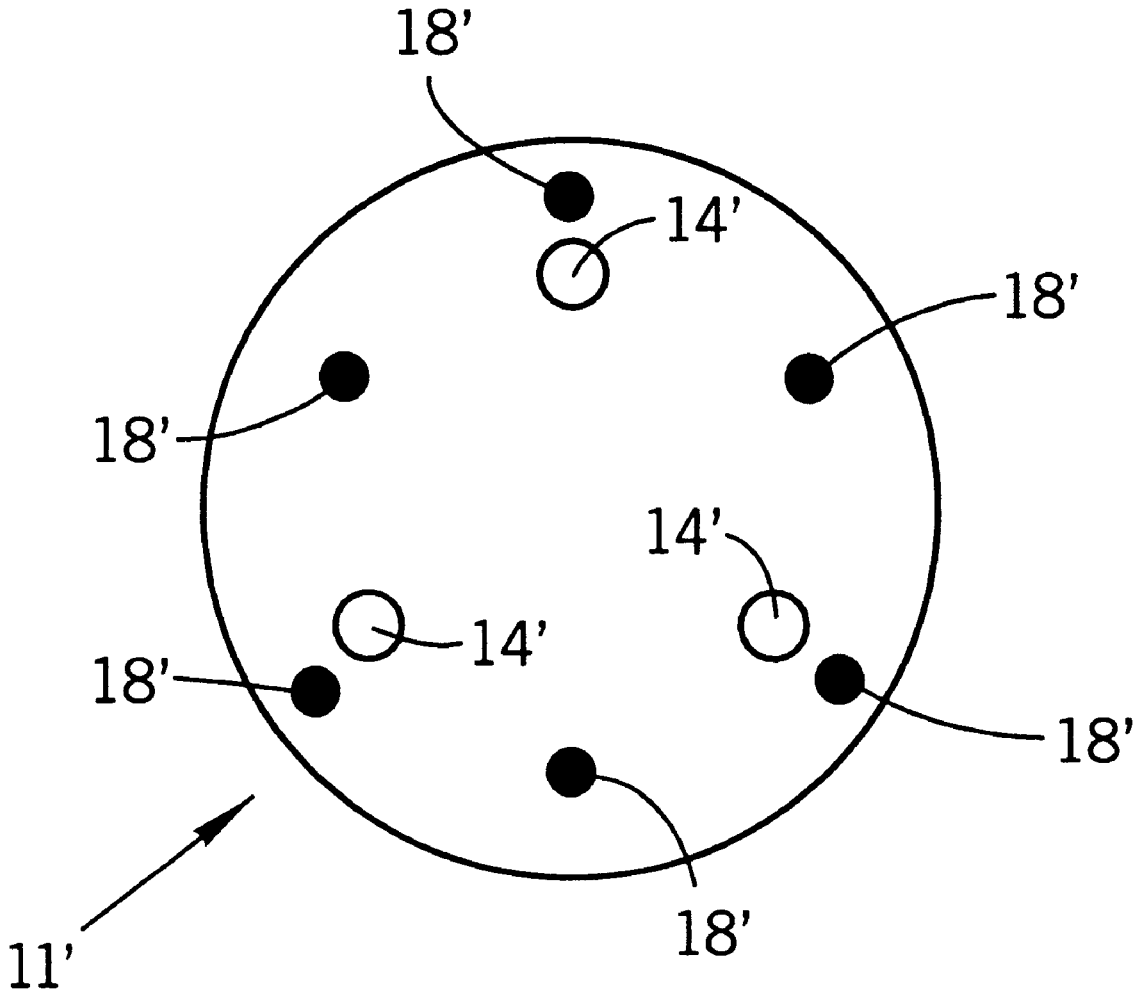
FIG. 5 is an enlarged diagrammatic plan view of polymer flow distribution plate that may be employed as an alternative to the distribution plate depicted in FIG. 2 to produce the fiber cross-section shown in FIG. 4.

Example 1 is repeated, except that the flows to the backhole are provided by a distribution plate 11' as shown in FIG. 5 having holes 14' to receive the MA-PP and polypropylene in a sheath-core arrangement, respectively, and holes 18' to receive substantially equal amounts of the nylon 6. The resulting fiber will have a cross-section as shown in FIG. 4.

Example 3 (Comparative)

Example 1 is repeated, except that the proportions of material are 75% nylon 6 and 25% polypropylene. No MA-PP is used. The resulting fiber will have a cross-section similar to that shown in FIG. 4, except that the boundary layer 26 is not present. Instead, the polypropylene domains 24 will be in direct contact at their boundaries with the nylon 6 domain 24.

When the fiber cross-section is viewed under a microscope, fibers from this Example 3 will show excessive delamination at the boundaries between the nylon 6 and the polypropylene domains. The fibers formed from Examples 1 and 2, however, will show good adhesion between all the domains. When these fibers are converted into carpets through methods well known in the art, the carpets made from the fibers of Example 3 will show wear much earlier when subjected to foot traffic as compared to carpets formed of the fibers from Examples 1 and 2.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A multicomponent synthetic fiber comprising;

(a) a first domain formed from a first polymer, (b) a second domain formed from a second polymer, wherein said first domain and said second domain are longitudinally coextensive, and (c) a compatibilizing boundary layer interposed between said first domain and said second domain, wherein said boundary layer comprises a grafted olefinic polymer.

2. A multicomponent synthetic fiber as in claim 1, wherein said first domain entirely surrounds said second domain, and wherein said boundary layer entirely surrounds said second domain.

3. A multicomponent synthetic fiber as in claim 1 or 2, wherein said first domain is formed of a nylon polymer.

4. A multicomponent synthetic fiber as in claim 3, wherein said second domain is formed from a polyolefin.

5. A multicomponent synthetic fiber as in claim 3, wherein said second domain is formed from a non-fiber-forming polymer.

6. A multicomponent synthetic fiber as in claim 5, wherein said second domain is formed from polystyrene, polyisobutene and poly(methyl methacrylate).

7. A multicomponent synthetic fiber as in claim 4, wherein said boundary layer is formed of a maleic anhydride modified polypropylene.

8. A multicomponent synthetic fiber as in claim 1, in the form of a trilobal fiber.

9. A trilobal, multicomponent synthetic fiber comprising:

(a) a nylon sheath domain, (b) at least three radially elongate core domains entirely surrounded by said sheath domain, and (c) a compatibilizing boundary layer entirely surrounding each of said core domains.

10. A multicomponent synthetic fiber as in claim 9, wherein said core domains are formed from a polyolefin.

11. A multicomponent synthetic fiber as in claim 10, wherein said boundary layer is formed from a maleic anhydride modified polypropylene.

12. A multicomponent synthetic fiber as in claim 9, wherein at least one of said core domains is formed from a non-fiber-forming polymer.

13. A multicomponent synthetic fiber as in claim 12, wherein said at least one core domain is formed from at least one polymer selected from the group consisting of polystyrene, polyisobutene and poly(methyl methacrylate).

14. A multi-lobal drawn multicomponent carpet fiber as in claim 1, which is tri-lobal.

15. A yarn comprised of a plurality of carpet fibers as in claim 14.

16. A fabric comprised of a plurality of fibers as in any one of claims 1–14.

* * * * *